US007597226B2

(12) United States Patent
Starr

(10) Patent No.: US 7,597,226 B2
(45) Date of Patent: Oct. 6, 2009

(54) DISPOSABLE AMPOULE OPENERS

(75) Inventor: Lisa Starr, McPherson, KS (US)

(73) Assignee: STARR Systems, LLC, McPherson, KS (US)

( * ) Notice: Subject to any disclaimer, the term of this patent is extended or adjusted under 35 U.S.C. 154(b) by 0 days.

(21) Appl. No.: 10/779,989

(22) Filed: Feb. 17, 2004

(65) Prior Publication Data

US 2004/0182904 A1 Sep. 23, 2004

Related U.S. Application Data

(63) Continuation of application No. 10/186,115, filed on Jun. 28, 2002, now Pat. No. 6,712,252.

(60) Provisional application No. 60/316,462, filed on Aug. 31, 2001, provisional application No. 60/333,199, filed on Nov. 16, 2001.

(51) Int. Cl.
*B67B 7/92* (2006.01)

(52) U.S. Cl. ..... 225/96.5; 225/103

(58) Field of Classification Search ..... 225/1, 225/93, 96.5, 103, 105; 241/99, 606, 168; 206/532, 446, 528; 215/46–49; 81/3.4, 3.44; D24/127, 131, 132; 220/4.21–4.24
See application file for complete search history.

(56) References Cited

U.S. PATENT DOCUMENTS 2,555,863 A * 6/1951 Slaughter ..... 206/530
3,380,608 A * 4/1968 Morbeck ..... 215/43
3,544,020 A * 12/1970 Shaw et al. ..... 215/47
3,951,296 A * 4/1976 Swanson et al. ..... 220/669
3,956,441 A * 5/1976 Uhlig ..... 264/530
4,029,202 A * 6/1977 Lasich et al. ..... 206/562
4,518,097 A * 5/1985 Milton et al. ..... 220/782
4,610,394 A * 9/1986 Bryson ..... 220/4.23
4,655,363 A * 4/1987 Neat ..... 215/306
4,674,640 A * 6/1987 Asa et al. ..... 215/230
4,809,874 A * 3/1989 Pehr ..... 220/833
4,934,556 A * 6/1990 Kleissendorf ..... 220/269
4,942,966 A * 7/1990 Kemp ..... 206/446
4,951,822 A * 8/1990 Fontana et al. ..... 206/530
5,129,566 A * 7/1992 Ogden et al. ..... 225/93
D359,234 S * 6/1995 Amin ..... D9/428
5,669,502 A * 9/1997 Ong et al. ..... 206/528
6,227,396 B1 * 5/2001 Small ..... 220/4.12
6,234,333 B1 * 5/2001 Federighi et al. ..... 215/48

* cited by examiner

*Primary Examiner*—Stephen Choi
(74) *Attorney, Agent, or Firm*—Douglas H. Elliott

(57) ABSTRACT

A method of opening an ampoule and an ampoule opening device are disclosed. The method in at least one of the embodiments includes providing a structure that includes an elongated housing having a longitudinal housing axis and an inner cavity, an open housing end, a closed housing end, sidewalls disposed between the open housing end and the closed housing end, the sidewalls having an outer housing surface and an inner housing surface forming at least a portion of the inner cavity; and a lid or rotatably flexibly secured to the elongated housing proximate the open housing end; positioning the upper tip portion of the ampoule in the elongated housing such that the upper tip portion is substantially enclosed within the inner cavity of the housing, the lower liquid portion is substantially outside the housing and the longitudinal ampoule axis is substantially parallel to the longitudinal housing axis; pressing the lid against the longitudinal outer surface of the lower liquid portion of the ampoule with a thumb or finger; bending the elongated housing with respect to the ampoule such that the longitudinal housing axis rotates with respect to the longitudinal ampoule axis and the neck portion of the ampoule breaks; and separating the longitudinal outer surface of the lower liquid portion of the ampoule from the lid, after which the lower liquid portion can be secured and the housing containing the upper tip portion of the ampoule disposed of.

29 Claims, 6 Drawing Sheets

DISPOSABLE AMPOULE OPENERS

CROSS-REFERENCE TO RELATED APPLICATIONS

This application is a continuation of, and claims benefit of, application Ser. No. 10/186,115, filed on Jun. 28, 2002, now U.S. Pat. No. 6,712,252 and also claims the benefit of U.S. provisional patent applications having Ser. Nos. 60/316,462, filed Aug. 31, 2001, and 60,333,199, filed Nov. 16, 2001, which are hereby incorporated by reference in their entireties.

BACKGROUND

1. Field of Invention

Embodiments of the present invention generally relate to ampoule opening methods and ampoule opening structures.

2. Description of Related Art

Various approaches have been proposed in connection with the opening of ampoules, particularly glass ampoules. Many of those approaches are described in earlier patents, including those cited herein. Those patents also describe a wide variety of structures, and certain ampoule-opening methods that are associated with those structures. Many of the structures are complex, others have parts that require undue assembly and still others have delicate or fragile construction, making them difficult to make or use, or both. While certain of those structures may have purported advantages, it is perceived by the present inventor that a need exists for an improved method of opening an ampoule that is simple, safe and effective, and that preferably includes disposal of the ampoule tip, and for an ampoule opening structure that is resilient and useful for safely opening an ampoule and disposing of the ampoule tip. In certain aspects, the present invention overcomes one or more of the shortcomings found in prior art devices and methods.

SUMMARY OF INVENTION

In at least one broad aspect, the invention is directed to a method of opening an ampoule, which includes one or more of the following actions, preferably in sequential order. In one aspect, the method may include providing an ampoule that has a longitudinal ampoule axis, a lower liquid portion containing liquid and an upper tip portion that is narrower in diameter than the lower liquid portion, the lower liquid portion having a longitudinal outer surface, the ampoule further having a neck portion disposed between the lower liquid portion and the upper tip portion; providing a structure that includes (a) an elongated housing having a longitudinal housing axis and an inner cavity, an open housing end, a closed housing end, sidewalls disposed between the open housing end and the closed housing end, the sidewalls having an outer housing surface and an inner housing surface forming at least a portion of the inner cavity; and (b). a lid flexibly secured to the elongated housing proximate the open housing end. The method preferably also includes positioning the upper tip portion of the ampoule in the elongated housing such that the upper tip portion is substantially enclosed within the inner cavity of the housing, the lower liquid portion is substantially outside the housing and the longitudinal ampoule axis is substantially parallel to the longitudinal housing axis. Also, the method preferably includes pressing the lid against the longitudinal outer surface of the lower liquid portion of the ampoule with a thumb or finger; bending the elongated housing with respect to the ampoule such that the longitudinal housing axis rotates with respect to the longitudinal ampoule axis and the neck portion of the ampoule breaks; separating the longitudinal outer surface of the lower liquid portion of the ampoule from the lid; securing the lower liquid portion of the ampoule; rotating the lid to cover the open housing end with at least a portion of the lid, such that the housing is substantially closed and contains the upper tip portion of the ampoule; and disposing of the housing containing the upper tip portion of the ampoule.

Preferably, for any of the methods disclosed herein, the structure additionally includes a latch for keeping the open housing end covered with at least a portion of the lid.

In any of the methods or structures disclosed herein, the lid preferably includes an aperture, the housing includes a protrusion sized to fit into the aperture and the method further includes fitting the protrusion into the aperture to secure the lid in a closed position.

In any of the methods or structures disclosed herein, the lid is preferably flexibly secured to the elongated housing by a plastic rotatable hinge, including in certain embodiments a lid that that is bendable and capable of being rotated so as to close the open housing end, and preferably being rotatable at least about 45 degrees or more preferably 60 degrees and most preferably 90 degrees or more, as reflected by the lid shown in FIGS. 1-6.

In any of the methods or structures disclosed herein, the outer housing surface of the elongated housing preferably has one or more outer ridges on the outer housing surface, preferably perpendicular to the longitudinal housing axis.

Preferably, the outer ridges circumscribe the entire outer housing surface.

In any of the methods or structures disclosed herein, the elongated housing preferably includes two housing portions (sections) hingedly connected to one another. Thus, when the portions or sections are swung (rotated) together to a closed position, they form a housing or cavity.

In any of the methods or structures disclosed herein, the elongated housing preferably includes two housing portions hingedly connected to one another, in which the inner housing surface forming at least a portion of the inner cavity includes at least one inner rib circumscribing (occupying the surface of) at least a portion of the inner housing surface proximate the open housing end and having an inner diameter sized to receive the neck portion of the ampoule, and in which the positioning of the upper tip portion of the ampoule includes placing the neck portion of the ampoule on the inner rib and closing the two housing portions to secure the neck portion of the ampoule.

In any of the methods or structures disclosed herein, the providing of a structure that includes an elongated housing and a lid preferably includes providing a first elongated housing portion and a second elongated housing portion, the first and second elongated housing portions being hingedly connected to one another such that the first elongated housing portion is capable of being rotated toward the second housing portion to form an enclosed cavity with an open housing end and a closed housing end, the first elongated housing portion having a substantially concave first inner surface, the second elongated housing portion having a substantially concave second inner surface, the structure further including one or more ribs forming part of the first elongated housing portion or the second elongated housing portion.

In any of the methods or structures disclosed herein, the elongated housing preferably includes a first housing portion and a second housing portion, the first and second housing portions being hingedly connected to one another, the first and second housing portions having one or more latches for securing the first and second housing portions together when in a closed position.

In at least one other broad aspect of this invention, a method of opening an ampoule includes one or more of the following actions, preferably in sequential order. The method preferably includes, for example, providing an ampoule that has a longitudinal ampoule axis, a lower liquid portion containing liquid and an upper tip portion that is narrower in diameter than the lower liquid portion, the lower liquid portion having a longitudinal outer surface, the ampoule further having a neck portion disposed between the lower liquid portion and the upper tip portion. Also, the method preferably includes providing a structure that includes a first elongated housing portion and a second elongated housing portion, the first and second elongated housing portions being hingedly connected to one another such that the first elongated housing portion is capable of being rotated toward the second housing portion to form an enclosed cavity with an open housing end and a closed housing end, the first elongated housing portion having a substantially concave first inner surface, the second elongated housing portion having a substantially concave second inner surface. The structure may further include one or more ribs forming part of the first elongated housing portion or the second elongated housing portion. The method preferably includes placing the upper tip portion of the ampoule against at least one of the one or more ribs; rotating the first elongated housing portion toward the second elongated housing portion to form a housing with an enclosed cavity inside which the upper tip portion of the ampoule is substantially enclosed and is in substantial contact with at least a portion of at least one of the one or more ribs, the cavity having two ends and being closed at one end and open at the other end, the lower liquid portion of the ampoule being substantially outside the housing; breaking the neck portion of the ampoule; securing the lower liquid portion of the ampoule; and disposing of the housing containing the upper tip portion of the ampoule.

In any of the methods or structures disclosed herein, the structure preferably further includes a lid rotatably secured to the elongated housing proximate the open housing end.

In any of the methods or structures disclosed herein, the structure preferably further includes a lid rotatably secured to the elongated housing proximate the open housing end and the method further includes pressing the lid against the longitudinal outer surface of the lower liquid portion of the ampoule with a thumb or finger and bending the elongated housing with respect to the ampoule such that the longitudinal housing axis rotates with respect to the longitudinal ampoule axis and the neck portion of the ampoule breaks.

In any of the methods or structures disclosed herein, the structure preferably further includes a lid flexibly secured to the elongated housing proximate the open housing end and the method further includes (a) pressing the lid against the longitudinal outer surface of the lower liquid portion of the ampoule with a thumb or finger; (b) bending the elongated housing with respect to the ampoule such that the longitudinal housing axis rotates with respect to the longitudinal ampoule axis and the neck portion of the ampoule breaks; and (c) rotating the lid to cover the open housing end with a portion of the lid, such that the housing is substantially closed and contains the upper tip portion of the ampoule.

In any of the methods or structures disclosed herein, the first and second elongated housing portions are connected by one or more flexible (and/or bendable) plastic members at the ends of the first and second elongated housing portions.

In any of the methods or structures disclosed herein, the first and second elongated housing portions are connected by one or more flexible plastic strips on the sides of the first and second elongated housing portions.

In any of the methods or structures disclosed herein, the first and second housing portions further include a connector for securing the first and second housing portions in a closed position.

In any of the methods or structures disclosed herein, the structure preferably additionally includes a lid flexibly secured to one end of the first elongated housing portion, in which the placing of the upper tip portion of the ampoule against at least one of the one or more inner ribs includes placing the structure in an open position in the palm of a hand, with the first elongated housing portion rotated away from the second elongated housing portion, with the elongated strip portion proximate the palm of the hand, laying the upper tip portion with the neck portion cradled in the inner rib, rotating the second elongated housing portion into a closed position; squeezing the second elongated housing portion toward the first elongated housing portion until the first and second elongated housing portions are securely attached to one another; rotating the structure so that the lower liquid portion is positioned directly below the upper tip portion; holding the base of the ampoule securely in one hand, gripping the structure in the other hand with a thumb on the lid, pulling the structure downward, snapping the ampoule at the neck portion, closing the lid followed by disposing of the structure containing the upper tip portion of the ampoule.

In another broad aspect the method of opening an ampoule includes one or more of the following actions, preferably in sequential order: providing an ampoule that has a longitudinal ampoule axis, a lower liquid portion containing liquid and an upper tip portion that is narrower in diameter than the lower liquid portion, the lower liquid portion having a longitudinal outer surface, the ampoule further having a neck portion disposed between the lower liquid portion and the upper tip portion; providing a structure that includes: (a) a first elongated housing portion, (b) a second elongated housing portion, (c) one or more inner ribs forming part of the first elongated housing portion or the second elongated housing portion and (d) a lid rotatably secured to the first or second elongated housing portions proximate the open housing end, the first and second elongated housing portions being hingedly connected to one another such that the first elongated housing portion is capable of being rotated toward the second housing portion to form an enclosed cavity with an open housing end and a closed housing end, the first elongated housing portion having a substantially concave first inner surface, the second elongated housing portion having a substantially concave second inner surface; placing the upper tip portion of the ampoule against at least one of the one or more inner ribs; rotating the first elongated housing portion toward the second elongated housing portion to form a housing with an enclosed cavity inside which the upper tip portion of the ampoule is substantially enclosed and is in substantial contact with at least a portion of at least one of the one or more inner ribs, the cavity having two ends and being closed at one end and open at the other end, the lower liquid portion being substantially outside the housing and the longitudinal ampoule axis being substantially parallel to the longitudinal housing axis; pressing the lid against the longitudinal outer surface of the lower liquid portion of the ampoule with a thumb or finger; bending the elongated housing with respect to the ampoule such that the longitudinal housing axis rotates with respect to the longitudinal ampoule axis and the neck portion of the ampoule breaks; separating the longitudinal outer surface of the lower liquid portion of the ampoule from the lid; securing the lower liquid portion of the ampoule; rotating the lid to cover the open housing end with a portion of the lid, such that the housing is substantially closed and contains the upper tip portion of the ampoule; and disposing of the housing containing the upper tip portion of the ampoule.

In addition to the methods identified above and elsewhere herein, a disposable ampoule opener is described, which includes an elongated housing member having an inner cavity, a longitudinal housing axis, an open housing end, a closed housing end, sidewalls disposed between the open housing end and the closed housing end, the sidewalls having an outer housing surface and an inner housing surface forming at least a portion of the inner cavity; and a lid rotatably secured by a hinge to the housing proximate the open housing end.

Any of the disposable ampoule openers described herein may additionally include a latch for keeping the open housing end covered with at least a portion of the lid.

Any of the disposable ampoule openers described herein may additionally include a latch that includes a first latch structure integral with the elongated housing proximate the open housing end and a second latch structure integral with the lid, the first and second latch structures being capable of interlocking to secure the lid in a closed position.

Any of the disposable ampoule openers described herein may additionally include means for securing the lid in a closed position, including not only a latch but also an alternative type of interlocking or adhesive structure that is capable of securing the lid so that the ampoule tip is secured.

In any of the disposable ampoule openers described herein, the elongated housing member may include two portions (sections) hingedly connected to one another.

In any of the disposable ampoule openers described herein, either the lid or the elongated housing member may include an aperture, and the elongated housing member or the lid includes a protrusion sized to fit into the aperture. Thus, the protrusion may be inserted into the aperture to secure the two together, and thus to secure the lid in a closed position.

In any of the disposable ampoule openers described herein, the lid can be flexibly secured to the elongated housing member by a plastic bendable hinge.

In any of the disposable ampoule openers described herein, the lid can have an outer surface with a substantially smooth portion outer surface and a raised portion. The raised portion may have the shape of a company logo.

In any of the disposable ampoule openers described herein, the closed housing end may be transparent.

In any of the disposable ampoule openers described herein, the outer housing surface of the elongated housing may have one or more outer ridges on a portion of the outer housing surface, the ridges being perpendicular to the longitudinal housing axis.

In one or more of the specific embodiments of the disposable ampoule openers described herein, the elongated housing includes two housing sections (portions) connected to one another, and the inner housing surface forming at least a portion of the inner cavity includes at least one inner rib circumscribing at least a portion of the inner housing surface proximate the open housing end and having an inner diameter sized to receive the neck portion of the ampoule.

In any of the disposable ampoule openers described herein, the first and second elongated housing portions are hingedly connected to one another such that the first elongated housing portion is capable of being rotated toward the second housing portion to form an enclosed cavity with an open housing end and a closed housing end, the first elongated housing portion having a substantially concave first inner surface, the second elongated housing portion having a substantially concave second inner surface, the structure further including one or more ribs forming part of the first elongated housing portion or the second elongated housing portion.

In any of the disposable ampoule openers described herein, the elongated housing includes a first housing portion and a second housing portion, the first and second housing portions being hingedly connected to one another, the first and second housing portions having one or more latches for securing the first and second housing portions together when in a closed position.

DETAILED DESCRIPTION OF THE PREFERRED EMBODIMENT

A. Introduction and Definitions

Figure 1:
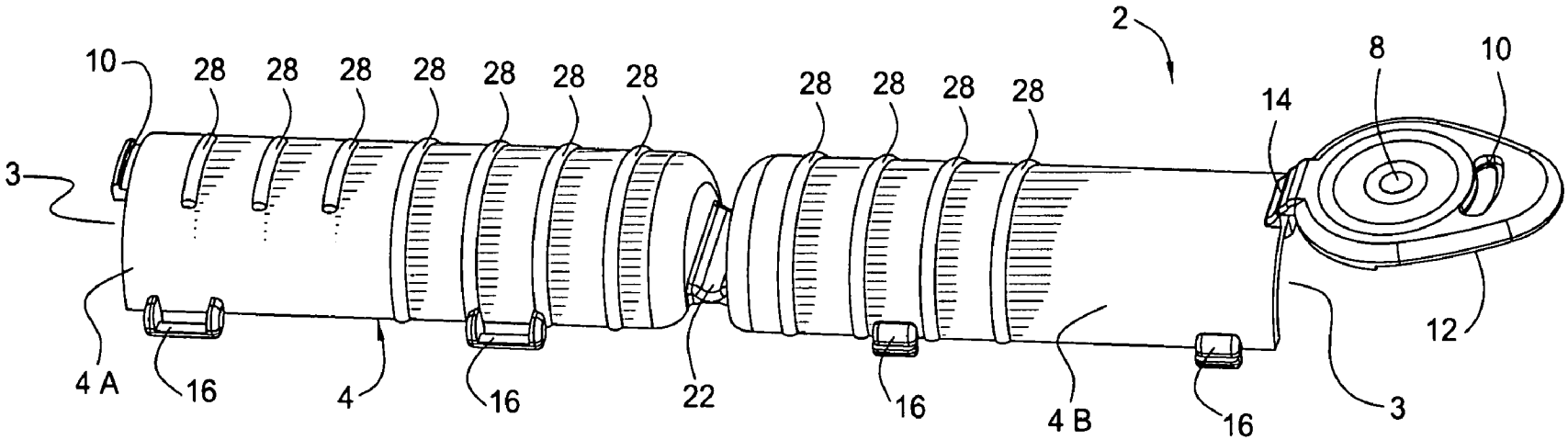
FIG. 1 is a perspective view of an example of an ampoule opener, in an open and unassembled position, i.e., in which the housing sections are open to accommodate an ampoule tip, and in which the lid is also open.

A detailed description will now be provided. Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims. Each of the inventions will now be described in greater detail below, including specific embodiments, versions and examples, but the inventions are not limited to these embodiments, versions or examples, which are included to enable a person having ordinary skill in the art of designing ampoule openers to make and use the inventions, when the information in this patent is combined with available information and technology. Various terms as used herein are defined below. To the extent a term used in a claim is not defined below, it should be given the broadest definition persons in the pertinent art have given that term as reflected in printed publications and issued patents.

The term "housing" refers broadly to a member that includes a cavity that is capable of covering an ampoule tip. Any structure that would be commonly recognized, referred to, or understood as a "housing" is considered to be a housing within the meaning of this patent. The housing may in certain embodiments be the same as the "shroud." Preferably, the housing has two portions, parts or sections, e.g., two halves, that are preferably rotatably, e.g., hingedly, connected to one another.

The term "lid" means a member, preferably a substantially flat member, or preferably a member having at least one substantially flat surface, as exemplified by the lid 12 in FIGS. 1-6. The lid is preferably affixed to one end of the housing, and positioned so that it is capable of rotating to close the housing opening and secure an ampoule tip within the housing. Any structure that would be commonly recognized, referred to, or understood as a "lid" is considered to be a lid within the meaning of this patent. Preferably, the lid is flat and includes a circular portion, which can occupy the entire portion of the lid that is not attached to the housing and/or that swings to fit over and cover the housing opening. As used herein, when referring to the lid, the term "circular" includes a shape that is a perfect circle in the classical geometric sense, i.e., with a constant diameter, but also broadly includes any shape that is rounded, including an oval or elliptical shape, or even the irregular oval shape of the lid shown in FIGS. 1-6. Although the shape of the circular lid is preferably non-rectangular, i.e., not having four corners, it may be rectangular in the sense that it includes four substantially straight edges and four rounded corners (not shown). The circular shape may also encompass a somewhat triangular shape having three rounded corners (not shown). The lid can be ridged or raised on the side or surface of the lid that faces toward the housing opening (which may be referred to as the "inner surface" of the lid) and which may fit onto or within the housing opening when rotated toward the housing portion. Preferably, the lid is affixed at one end, e.g., rotatably attached, to either the housing member, e.g., one of the housing member sections or portions, at the housing opening, or to a hinge that is operably connected to the housing. The end that is attached to the housing or the hinge may be referred to as the "proximal" end of the lid, which preferably includes the axis around which the lid rotates. The other end of the lid (referred to as the "distal" end) preferably extends or points away from the shroud of other housing member when in an open position, and swings or rotates toward the housing when in a closed position.

The term "latch" means a member that is capable of connecting and preferably holding or securing at least two objects together, e.g., a housing having an opening and a lid that rotates towards the housing opening. Any structure that is commonly recognized, referred to, or understood as a "latch" is considered to be a latch within the meaning of this patent. A latch may, for example, include any feature that fits into an aperture and thereby holds two members together due to the interconnectivity that is created, e.g., a protrusion, and may also include the aperture as well. Specific examples of latches are disclosed in the drawings, but the term "latch" is not limited to the structures in the drawings. The latch may broadly refer to two latch mechanisms that connect together, or the term "latch" may refer to only one of the individual latch mechanisms.

The term "hinge" means a member, device, or structure having a separate or integral axis around which two elements or members rotate, including a flexible member that is capable of flexible movement between two pieces along an axis. A hinge may also be a structure (or integral part of another structure) that supports rotatable movement, or a joint that itself operates as an axis around which two other members are capable of rotating. Any structure that is commonly recognized, referred to, or understood as a "hinge" is considered to be a hinge within the meaning of this patent. One example of a hinge (not shown) is a thin flexible plastic strip, which may have one or more indentions to provide or accommodate rotation along an axis. Specific examples of hinges are shown in the drawings, but the term "hinge" is not limited to the structures in the drawings.

The term "rib" as used refers to any portion of the inner surface of the housing member that possesses a smaller circumference than that of the surrounding housing. Any structure that is commonly recognized, referred to, or understood as a "rib" is considered to be a rib within the meaning of this patent. A rib may circumscribe all or part of the inner housing surface. Examples of ribs are shown in the drawings.

The term "ampoule" refers to a small, hermetically sealed vial, typically made of glass, usually holding a single dose of a solution used for hypodermic injection. The ampoule "tip" is the portion of the ampoule that is typically broken off or removed prior to dispensing of the solution. Typically, for ampoules having narrow neck portions, e.g., like those shown in the drawings, the ampoule tip is narrower than the body of the ampoule but wider than the ampoule neck.

The term "aperture" refers broadly to any opening, gap, cleft, or chasm, or refers to the diameter of an opening through which a substance or protrusion can fit.

The term "apex" refers to a point, or summit of an object, e.g., an ampoule, which has a tip that includes an apex.

The term "protrusion" refers to an object or portion of an object that projects, as from confinement or from a small opening or from a surface or other portion of an object.

B. Alternative Embodiments

Various examples of ampoule openers (also called "ampoule breakers") and individual aspects of ampoule openers are shown in the attached drawings, which reflect the existence of alternative structures for the ampoule opener of this invention, and alternative methods of opening ampoules.

Figure 6:
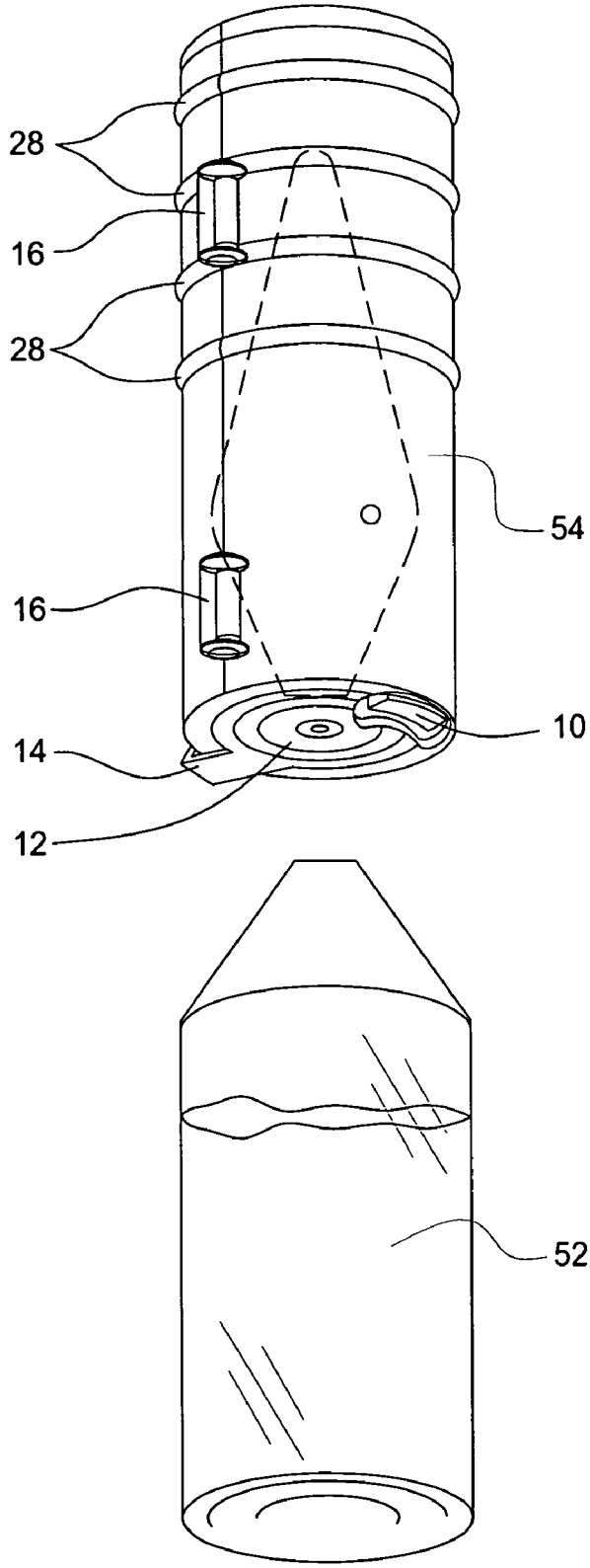
FIG. 6 is a perspective view of the ampoule opener of FIGS. 1-5 in an assembled and closed position, in which the housing sections and the lid are closed, and the ampoule tip that has been broken off from the remainder of the ampoule is secured within the cavity, in condition for disposal.
Figure 7:
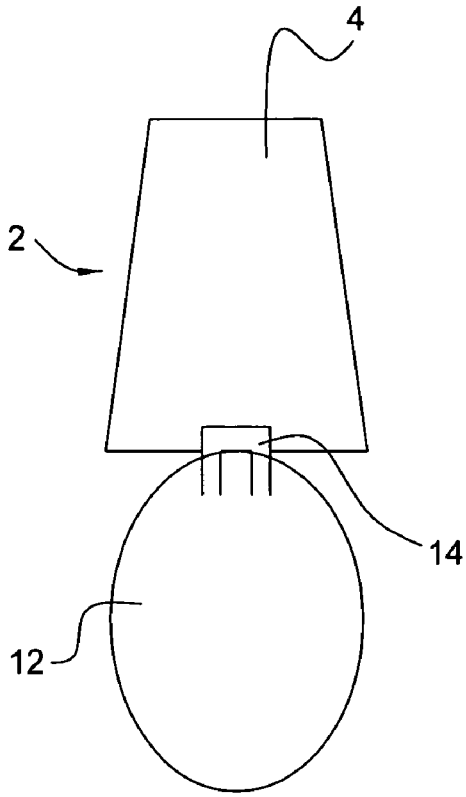
FIG. 7 is a simplified front view of an ampoule opener, having a cup-shaped unitary housing (e.g., shroud) with a circular lid rotatably connected via a hinge to one side of the open end of the housing and a latch to secure the circular lid to the other end of the open end of the housing.
Figure 8:
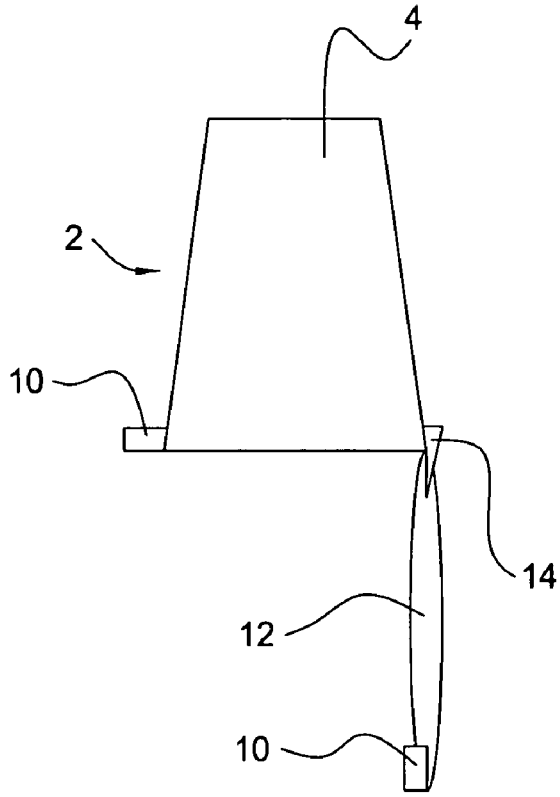
FIG. 8 is a simplified side view of the ampoule opener illustrated in FIG. 7, showing the lid in an open position, and the relationship between the lid and the portion of the latch that is part of the housing.
Figure 9:
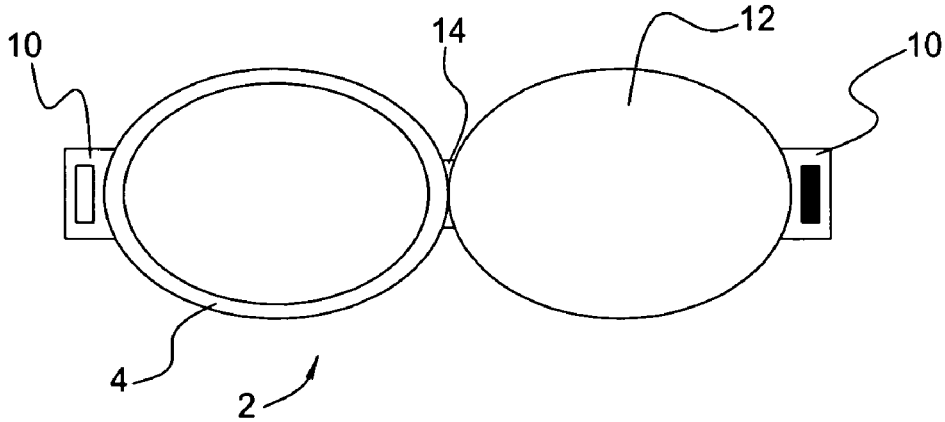
FIG. 9 is a simplified top view of the ampoule opener in FIGS. 7 and 8.
Figure 10:
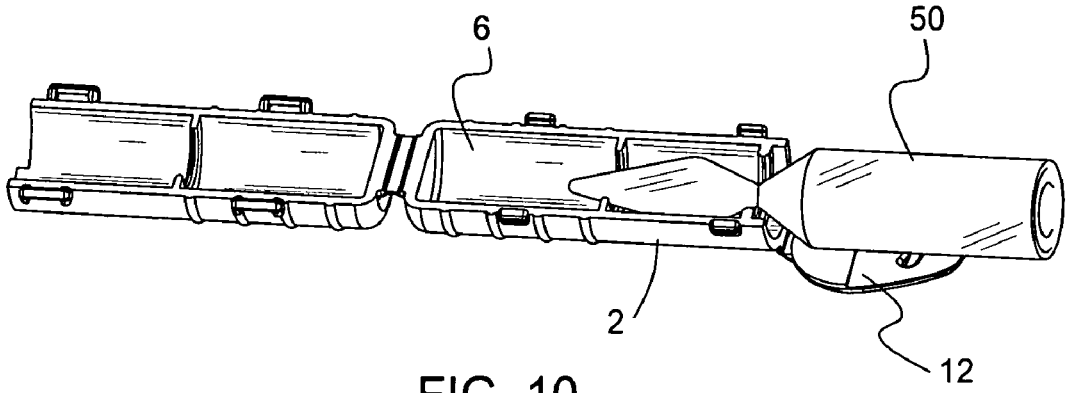
FIG. 10 is a perspective view of an ampoule opener such as that shown in FIGS. 1-6 with an ampoule cradled in one of the housing sections.
Figure 11:
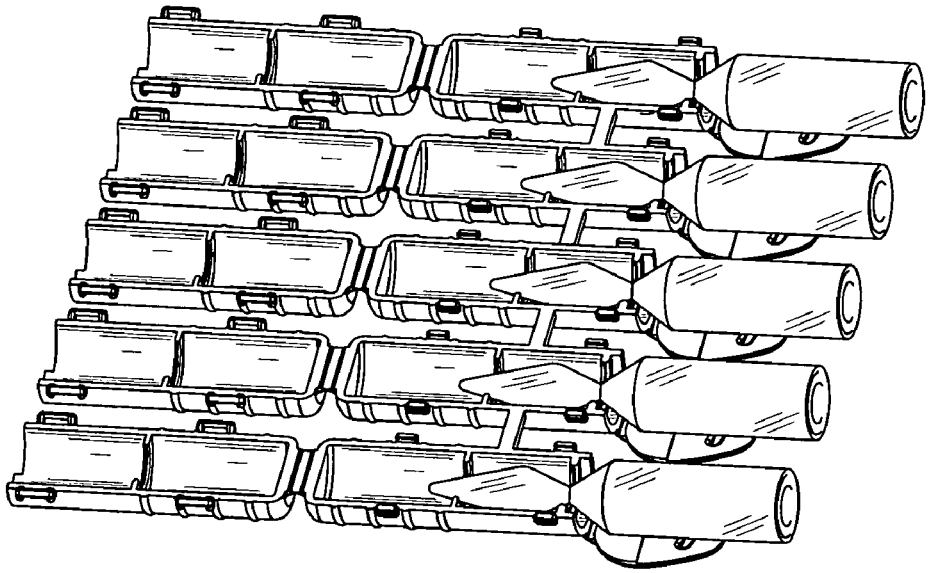
FIG. 11 is a perspective view of a specific embodiment of the ampoule opener, which includes a series of housing sections positioned parallel to one another, connected via one or more plastic strips, which can be broken so as to remove individual ampoule opening structures.

The ampoule opener can be used to break the top or tip off an ampoule. In at least one specific embodiment, the ampoule opener includes a hollow member or container having a concave surface, preferably a cup-shaped or dome-shaped "shroud" (container) that has an open end and a closed end, which can fit over the top of an ampoule. The opener thus may come in different sizes, depending on the size of the ampoule. One example of this structure is seen in FIGS. 1-6, while another example of the structure is shown in FIGS. 7-9. Note that the structure in FIGS. 1-6 has a housing with two connected sections or halves, while the structure in FIGS. 7-9 includes a unitary housing, resembling a cup. In general, the ampoule opener preferably also includes a flat member, preferably a lid, which can be elongated and which can also include a circular portion, preferably having a circumference that is slightly less than the circumference of the shroud opening so that it can fit into the shroud opening when the shroud is closed using the lid. The thumb is preferably placed on the flat, circular portion. The shroud may include a latch, in which case the circular portion of the thumb protector may be larger than the circumference of the shroud opening. The latch may be located on the inside of the shroud, e.g., a plastic ridge or retaining member that connects to some portion of the lid, so that the lid or thumb protector can swing toward the shroud opening and close that opening, thus securing the ampoule top inside the shroud. The elongated member can be flexibly or hingedly connected to one side of the hollow member, and preferably functions as a thumb protector and preferably also a lid. One of the specific embodiments includes a dome-shaped shroud (not shown) and a flat thumb protector. The shroud can be made of a flexible plastic or rubber so that the sides of the shroud may be squeezed to break the neck of a glass ampoule. However, the shroud may alternatively be made of more rigid plastic, e.g., a thermoplastic such as polyethylene, polypropylene, polybutylene, or polycarbonate. Also, while the shroud is preferably cylindrical (or substantially cylindrical), as seen in FIGS. 1-11, it may also be shaped so as to have an oval or elliptical cross-section. After the opener is used to break open the ampoule (discussed below), the thumb protector is preferably used as a lid, which after being closed, the entire opener can be disposed of together with the ampoule top. Thus, the ampoule opener is preferably a disposable, single-use ampoule opener.

Various methods of opening an ampoule have also been invented, as reflected in the claims, and certain aspects of those methods will now be described. A specific embodiment of the method will be discussed in the context of specific types of ampoule opener, e.g., the ones shown in FIGS. 1-6 and 7-9, but it is recognized that the method can be followed with other structures as well, and that other methods can also be used. To open an ampoule, the shroud portion of the ampoule opener, e.g., the housing, is preferably placed over the top of an unopened ampoule, e.g., by placing the cup-shaped portion over the ampoule top. The thumb protector should be positioned parallel to the sides of the ampoule. The thumb of the right hand should then be placed against the thumb protector with the right hand index finger positioned on the opposite side of the shroud, exerting slight pressure against the side of the ampoule. The lower portion of the ampoule can be held with the other hand (left hand). The right index finger is then curled back toward the right thumb, such that leverage snaps the top of the ampoule (covered by the shroud). The right hand thumb is then used to flip the thumb protector (e.g., now functioning as a lid) into the opening of the shroud. The ampoule opener can then be disposed of together with the ampoule top.

As noted above in the summary, various embodiments of an ampoule-opening method and device (structure or apparatus) are within the scope of the discovery, some of which are disclosed for illustrative purposes in the drawings. An example of an ampoule-opening device shown in FIGS. 1-6 has structural attributes including a hollow elongated body structure designed to safely house the broken-off ampoule top or tip. Referring now to FIGS. 1-6, that device 2 includes an elongated housing member 4 having an essentially cylindrical (i.e., including one having an oval, elliptical, triangular, or rectangular cross-section) inner cavity that is closed at one end and open at the opposite end. See, e.g., FIGS. 1-6. The size of the inner cavity 6 of the housing accommodates an ampoule tip. In the structure shown in FIGS. 1-6, the inner cavity 6 can be made of concave half-cavities 6*a*, 6*b*. Therefore, the actual size of the housing member may vary depending upon the size of the ampoule. An embodiment of this invention includes two halves 4*a*, 4*b* of a housing 4 divided along the longitudinal axis of the housing and connected by a hinge 22, as exemplified in FIGS. 1 and 2. The hinge 22 may be positioned at either the bottom closed end (shown) or along the side of the ampoule opener housing (not shown). A hinge enables the two halves of the housing to be folded onto an ampoule tip. See e.g., FIGS. 3 and 5. One or more latches 16 placed along the edges of the halves hold the housing together in an assembled position in order to create the essentially cylindrical cavity described above. An embodiment of the housing described herein includes ridges 28 positioned around at least a portion of the exterior surface of the housing. Preferably, the portion of the housing closest the open housing end is either without ribs at all or has ribs only partially circumscribing the surface. Accordingly, for a structure having a transparent housing, e.g., one made of a clear plastic, the portion of the housing without ribs (see, e.g., FIGS. 1-6) is sufficiently transparent and unobstructed that one can easily and quickly view the interior of the housing, e.g., the cavity, to ensure that no liquid is left in the cavity after the ampoule is broken. Also, at least one rib 20 may circumscribe a portion or the entire interior of the housing when assembled. The rib is preferably circular or semi-circular (as used herein, the term "circumscribe" describes either a portion or all of the inner surface.) The inner diameter of the rib 20 should be sized and shaped to receive the tip portion of the ampoule. A preferred embodiment of the housing structure includes at least two ribs 20, with one of the ribs 20 being located proximate the opening and having an diameter smaller than the diameter of the other rib 20, which is located farther away from the opening. The rib that is located more proximate the opening has an inner diameter that is greater than the outer diameter of the neck portion of the ampoule, so that when the housing sections are closed and latched, the neck portion of the ampoule is encircled and essentially clamped by the rib so that the neck portion is secured for breaking and so the ampoule tip does not slide back toward the housing opening.

Figure 2:
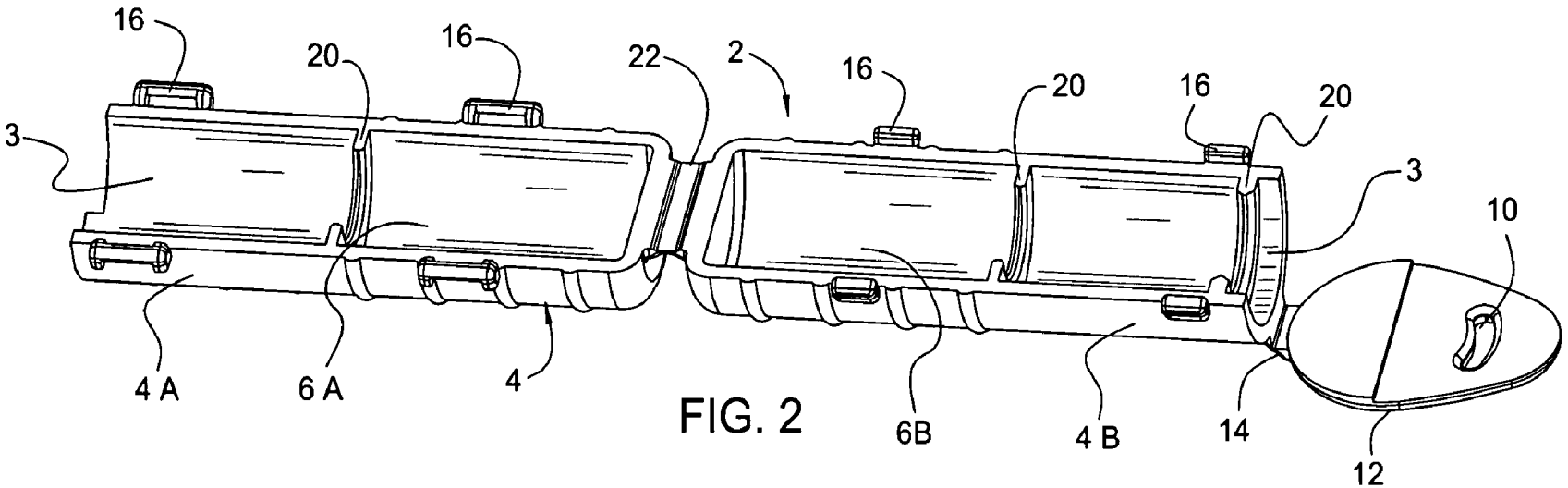
FIG. 2 is a perspective view of the ampoule opener of FIG. 2, showing the inside surfaces of the housing sections.
Figure 3:
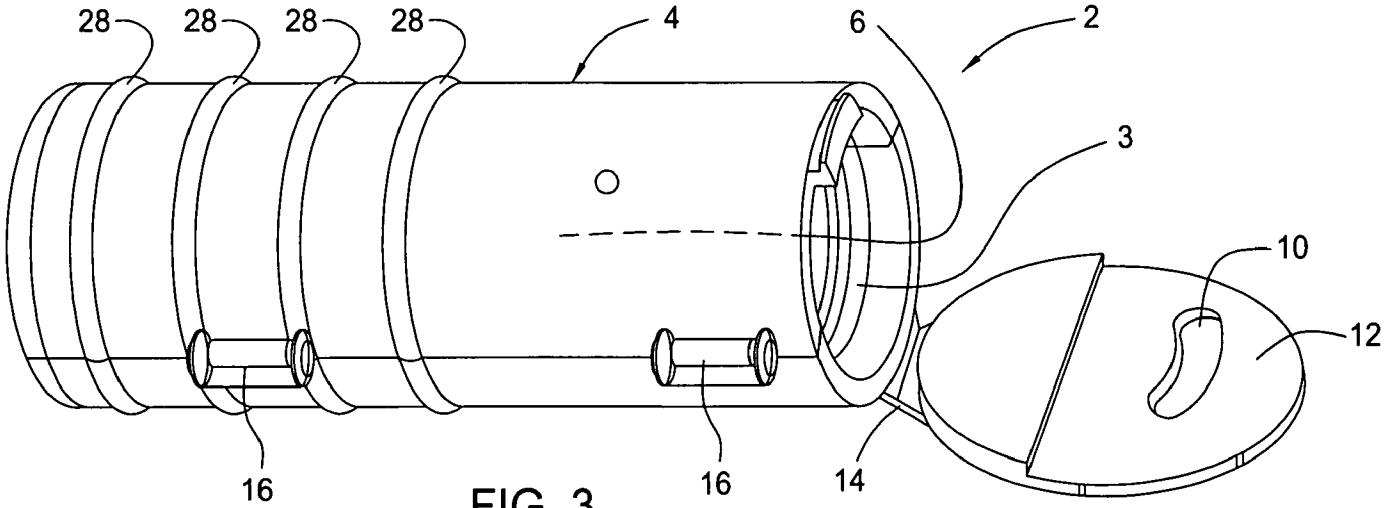
FIG. 3 is a perspective view the ampoule opener of FIGS. 1-2, in an assembled position, in which the two housing sections are closed and secured, e.g., latched, and the lid is open.
Figure 4:
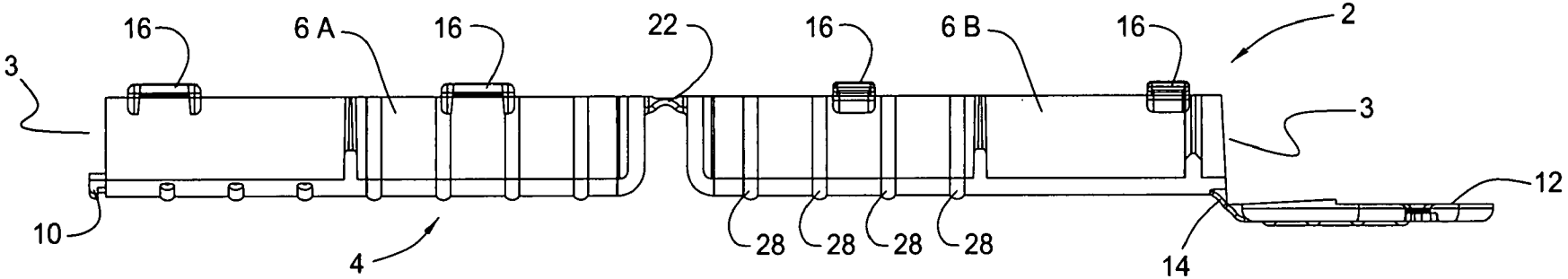
FIG. 4 is a side view of the ampoule opener of FIGS. 1-3, in an unassembled and open position, as in FIGS. 1-2, in which the housing sections are open to accommodate an ampoule tip, and in which the lid is also open.

Both ridges (outside surface) and ribs (inside surface) can be integrally created during the molding of the housing member. Preferably, the entire ampoule opener 2, including both the housing and lid, is a single integral structure, which can be made from a mold. A flat, elongated strip member 12, e.g., a lid, preferably extends beyond the cavity's open end, as seen in FIGS. 2-4. A hinge 14 at the open end of the housing attaches this member to the housing so that it swings (rotates) toward the cavity's opening. In one embodiment of the invention, the extension is a circular portion of essentially the same circumference as the open end of the housing, or slightly larger. The strip member serves both as a thumb protector while breaking the ampoule tip and as a closure or lid to the housing upon moving the hinged elongated member approximately ninety degrees, but possibly less or even more, depending on the angle defining the edge of the open end 3 of the housing 4, which in certain embodiments may be slanted at less-than-perpendicular with respect to the sidewalls of the housing (not shown). A latch 10 secures the elongated member in the closed position over the housing opening once the ampoule tip is broken off the ampoule. Therefore, the entire opener and the broken ampoule tip can be disposed of together in a safe manner, as illustrated in FIG. 6.

Further, in at least one version of the invention, the surface of the elongated strip member has specific markings 8 (e.g., raised portions or ridges), which can be incorporated during the molding of the housing. Accordingly, markings can be shaped like a company logo, incorporated on or overlapping the area of the elongated member where the thumb is placed during use. In the structure shown in FIGS. 1-6, the hypothetical company logo on the outer surface of the lid is an "O." This logo portion typically occupies the outside of the lid, but it is also contemplated that the logo ridges can alternatively be placed inside the lid. As discussed in the summary and elsewhere herein, or as an alternative to the structure shown in FIGS. 1-6, a one-piece body structure can be formed, molded, or otherwise shaped from a flexible plastic or rubber so that the sides of the elongated member may be squeezed while breaking the neck of the ampoule. Such structure is exemplified in FIGS. 7-9. The preferred plastic (e.g., a thermoplastic) would be transparent to permit visibility of the contents in the ampoule opener and flexible so as to allow for the hinges described herein. Fabrication of the device can be completed with conventional techniques known in the art of forming plastic structures.

Figure 5:
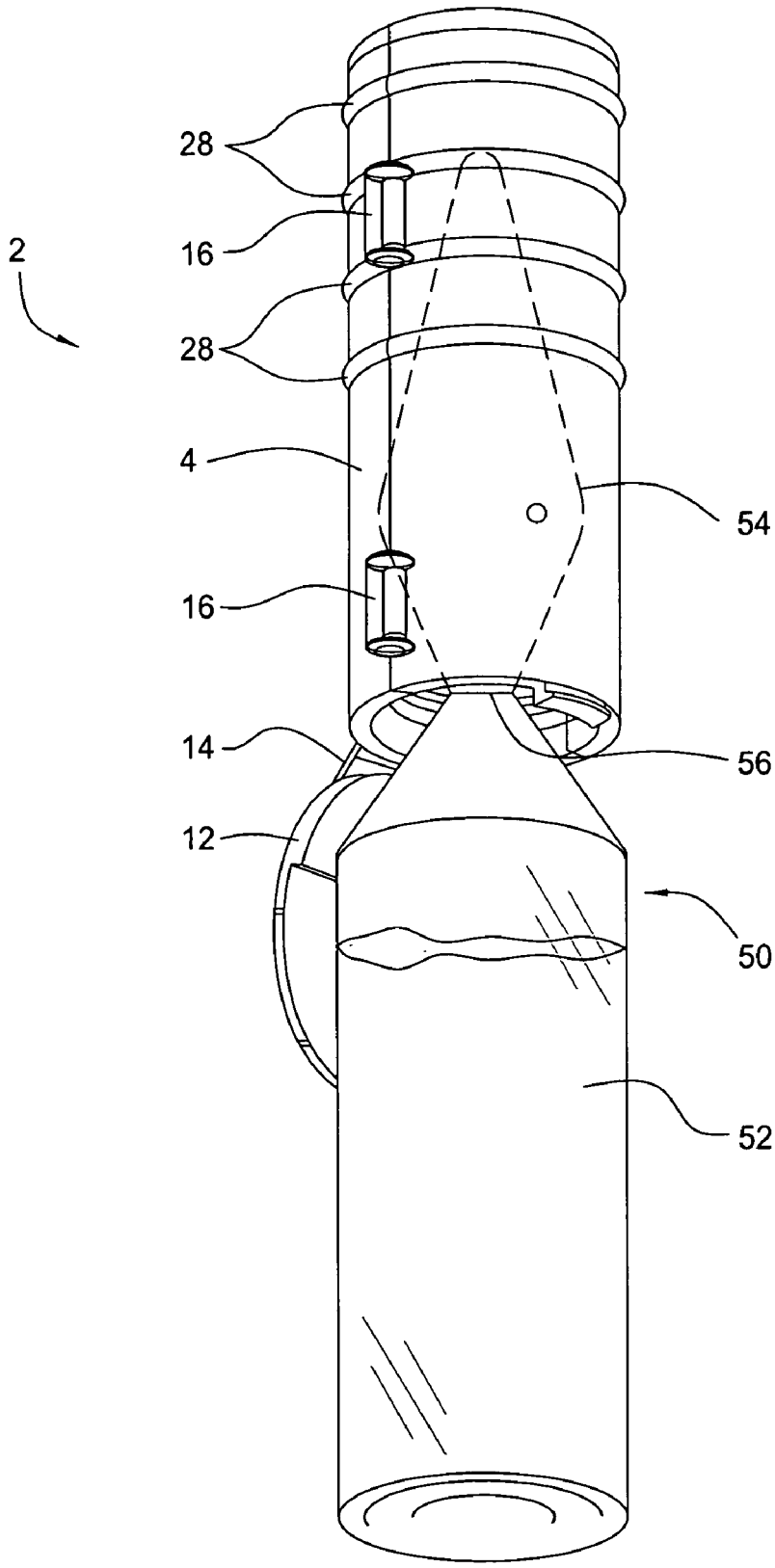
FIG. 5 is a perspective view illustrating an unbroken ampoule with its tip inside the ampoule opener of FIGS. 1-4.

The shroud portion of one or more of the ampoule openers described herein, e.g., a housing member 4 having a cavity 6, can be placed over the top of an unopened ampoule, as shown in FIG. 5. Therefore, the upper tip portion 54 of the ampoule 50 can be substantially or completely enclosed in or by the inner cavity 6 of the housing and the lower liquid portion 52 can be substantially outside the housing 4. The thumb protector 12 should be positioned parallel to the sides of the ampoule as shown in FIGS. 1-2 and 4-5. Positioning the thumb on the thumb protector and the index finger around the shroud or housing allows the user to exert slight pressure against the side of the ampoule. The lower portion of the ampoule that contains the liquid should be held with the other hand. Curling the index finger wrapped around the shroud towards the thumb provides the necessary leverage to break the top off of the ampoule. Finally, the thumb can close the opening of the housing that now contains the ampoule tip by flipping the thumb protector 12 into the opening 3 of the housing, as shown in FIG. 6. A hinge 14 allows for the movement to perform this task. Therefore, the thumb protector 12 preferably also functions as a lid. A latch secures the lid in its closed position to the housing member. The enclosed ampoule tip and the entire ampoule opening device can then be safely discarded.

The method described above may be performed with an ampoule opening device that is described herein. As indicated above, logos may be formed into the lid, e.g., by being molded on the outside of the lid, facing away from the housing when the lid is in the closed position. Ribs and ridges may be introduced on the interior and exterior of the housing respectively. Further, rotating two halves of the housing along a hinged axis and securing them together with a latching device may form the cavity or shroud portion.

In utilizing the ampoule opening device of this invention, the tip portion 54 of an ampoule 50 may be placed on the inner concave surface of one or both of the two elongated housing halves 4*a* and 4*b*. Placement of the ampoule should be done so that at least one or more ribs 20 on the housing's inner surface contacts the upper portion of the ampoule tip. The opposite elongated housing portion can be rotated at the hinge 22 in order to enclose the ampoule tip 54. A latch, e.g., latching device 16, secures the two housing portions 4*a*, 4*b* in the closed position. Therefore, the upper tip portion of the ampoule is substantially enclosed in the inner cavity of the housing and the lower liquid portion is substantially outside the housing. Applying leverage against the ampoule opening device and the lower ampoule liquid portion breaks the neck 56 of the ampoule, as reflected in FIGS. 5 and 6. The lower liquid portion of the ampoule is ready for securing and use, as illustrated in FIG. 6 and the entire ampoule opening device 2 that contains the upper tip portion 54 can be disposed of safely.

The method described above may be performed with any of the ampoule opening devices that are illustrated or otherwise described herein.

What is claimed is:

1. A disposable ampoule opener in combination with an ampoule, wherein the ampoule has a lower liquid portion capable of containing liquid and an upper tip portion that is narrower in diameter than the lower liquid portion, the ampoule further having a neck portion disposed between the lower liquid portion and the upper tip portion, and wherein the disposable ampoule opener comprises a plastic elongated housing that includes a first elongated housing section and a second elongated housing section hingedly connected to the first elongated housing section and at least one latch capable of securing the first elongated housing section to the second elongated housing section and defining an inner cavity shaped to receive a portion of the ampoule, wherein the plastic elongated housing includes (a) an open housing end, (b) a closed housing end, (c) sidewalls disposed between the open housing end and the closed housing end, the sidewalls having an outer housing surface and an inner housing surface forming at least a portion of the inner cavity, (d) at least one inner rib circumscribing at least a portion of the inner housing surface proximate the open housing end; and (e) a lid secured proximate the open housing end, the lid being capable of a closed position and an open position.

2. The disposable ampoule opener combined with an ampoule as recited in claim 1, wherein the lid includes an aperture and at least one of the elongated housing sections includes a protrusion sized to fit into the aperture.

3. The disposable ampoule opener combined with an ampoule as recited in claim 1, wherein at least one of the elongated housing sections is fully or partially transparent.

4. The disposable ampoule opener combined with an ampoule as recited in of claim 1, wherein each of the elongated housing sections is opaque and the lid is transparent.

5. The disposable ampoule opener combined wit an ampoule as recited in claim 1, wherein at least one of the elongated housing sections includes two or more outer ridges.

6. The disposable ampoule opener combined with an ampoule as recited in claim 1, wherein the plastic elongated housing includes two latches capable of securing the first elongated housing section to the second elongated housing section to define the inner cavity.

7. The disposable ampoule opener combined with an ampoule as recited in claim 1, wherein the lid includes a substantially planar outer surface with a raised portion having a predetermined shape.

8. The disposable ampoule opener combined with an ampoule as recited in claim 1, in which the lid is hingedly secured proximate the open housing end by a hinge that includes a first plastic binge member and a second plastic hinge member, which are rotatable relative to one another, wherein the first plastic hinge member is stationary relative to the plastic housing and the second plastic hinge member is stationary relative to the lid.

9. A disposable ampoule opener in combination with an ampoule, wherein the ampoule has a lower liquid portion capable of containing liquid and an upper tip portion that is narrower in diameter than the lower liquid portion, the ampoule further having a neck portion disposed between the lower liquid portion and the upper tip portion, and wherein the disposable ampoule opener comprises a plastic elongated housing that includes a first elongated housing section and a second elongated housing section hingedly connected to the first elongated housing section and at least one latch capable of securing the first elongated housing section to the second elongated housing section and defining an inner cavity shaped to receive a portion of the ampoule, wherein the plastic elongated housing further includes (a) an open housing end, (b) a closed housing end, (c) sidewalls disposed between the open housing end and the closed housing end, the sidewalls having an outer housing surface and an inner housing surface forming at least a portion of the inner cavity; (d) a lid secured to the housing proximate the open housing end, the lid being capable of a closed position and an open position, and (e) a latch to mechanically secure the lid in the closed position.

10. A disposable ampoule opener in combination with an ampoule, wherein the ampoule has a lower liquid portion capable of containing liquid and an upper tip portion that is narrower in diameter than the lower liquid portion, the ampoule further having a neck portion disposed between the lower liquid portion and the upper tin portion, and wherein the ampoule opener comprises a plastic elongated housing that: (a) includes a first elongated housing section and a second elongated housing section; (b) is capable of being in an open position or a closed position; (c) is capable of defining an inner cavity shaped to receive at least the upper tip portion of the ampoule when in the closed position; (d) has an open housing end and a closed housing end when in the closed position; (e) has sidewalls disposed between the open housing end and the closed housing end, the sidewalls having an outer housing surface and an inner housing surface that forms at least a portion of the inner cavity; (f) has at least one inner rib or rib section that fully or partially circumscribes at least a portion of the inner housing surface proximate the open housing end, to clamp the ampoule at the neck portion; (g) includes a lid secured to at least one of the first or second elongated housing sections proximate the housing end) the lid being capable of being in a closed or an open position.

11. The disposable ampoule opener combined with an ampoule as recited in claim 10, wherein one of the first or second elongated housing sections has the lid secured thereto proximate the open housing end; the lid is hingedly secured; and the other of the first or second elongated housing sections has a latch capable of securing the lid in a closed position.

12. The disposable ampoule opener combined with an ampoule as recited in claim 10, wherein the plastic elongated housing is cylindrical.

13. The disposable ampoule opener combined with an ampoule as recited in claim 10, wherein the plastic elongated housing comprises polypropylene.

14. The disposable ampoule opener combined with an ampoule as recited in claim 10, wherein the first and second elongated housing sections are hingedly connected to one another.

15. The disposable ampoule opener combined with an ampoule as recited in claim 10, wherein the first and second elongated housing sections are hingedly connected to one another at the closed housing end.

16. The disposable ampoule opener combined with an ampoule as recited in claim 10, wherein the plastic elongated housing includes a latch to secure the first elongated housing section to the second elongated housing section when the plastic elongated housing is in a closed position.

17. The disposable ampoule opener combined with an ampoule as recited in claim 10, wherein the plastic elongated housing includes two latches to secure the first elongated housing section to the second elongated housing section when the plastic elongated housing is in a closed position.

18. The disposable ampoule opener combined with an ampoule as recited in claim 10, wherein the plastic elongated housing includes only a single latch to secure the first elongated housing section to the second elongated housing section, wherein the latch is located closer to the open housing end than to the closed housing end.

19. The disposable ampoule opener combined with an ampoule as recited in claim 10, wherein the plastic elongated housing includes a latch to secure the first elongated housing section to the second elongated housing section, wherein the latch includes a first latch member which comprises an elongated aperture and is affixed to the first elongated housing section and a second latch member which comprises an elongated protrusion and is affixed to the second elongated housing section, and wherein the elongated protrusion is sized and shaped to fit into the elongated aperture of the first elongated housing section and hold the first and second elongated housing sections together.

20. The disposable ampoule opener combined with an ampoule as recited in claim 10, wherein the lid has an outer diameter that is larger than the outer diameter of the plastic elongated housing when the first and second housing sections are in a closed position.

21. The disposable ampoule opener combined with an ampoule as recited in claim 10, wherein the lid has an irregular oval shape.

22. The disposable ampoule opener combined with an ampoule as recited in claim 10, wherein the lid has a rectangular shape.

23. The disposable ampoule opener combined with an ampoule as recited in claim 10, wherein the lid is hingedly connected to either the first or second elongated housing sections.

24. The disposable ampoule opener combined with an ampoule as recited in claim 10, wherein the lid is hingedly connected to either of the first or second elongated housing sections by a plastic hinge that includes a first binge surface affixed to the first or second elongated housing sections, a second binge surface affixed to the lid and an indentation disposed between the first hinge surface and the second hinge surface, which indentation serves as an axis around which the second hinge surface can rotate such that the lid is capable of an open or closed position.

25. The disposable ampoule opener combined with an ampoule as recited in claim 10,wherein the lid has an outer surface with one or more ridges.

26. The disposable ampoule opener combined with an ampoule as recited in claim 10,wherein the lid bas an outer surface that includes a company logo.

27. The disposable ampoule opener combined with an ampoule as recited in claim 10, wherein the housing is cylindrical and includes from 2-5 ridges on the outer surface of the housing, where such ridges circumscribe at least half of the circumference of the outer surface of the housing and where at least one half of the length of the housing is smooth and has no ridges.

28. The disposable ampoule opener combined with an ampoule as recited in claim 10, wherein a rib section is provided that is proximate the open housing end and circumscribes the inner surface of either the first or second housing sections but does not fully circumscribe the inner surface of the plastic housing.

29. The disposable ampoule opener combined with an ampoule as recited in claim 10, wherein a first rib section is provided that is proximate the open housing end and circumscribes the inner surface of either the first or second housing sections but does not fully circumscribe the inner surface of the plastic housing; and wherein a rib is provided that is between the first rib section and the closed housing end and that circumscribes the entire inner surface of the plastic housing.

* * * * *